US011214857B2

(12) United States Patent
Yokota et al.

(10) Patent No.: US 11,214,857 B2
(45) Date of Patent: Jan. 4, 2022

(54) METHOD FOR MANUFACTURING ALUMINUM ALLOY MEMBER

(71) Applicant: TOYOTA JIDOSHA KABUSHIKI KAISHA, Toyota (JP)

(72) Inventors: Yusuke Yokota, Okazaki (JP); Hirotsune Watanabe, Miyoshi (JP); Makoto Kikuchi, Nisshin (JP); Hiroshi Kawahara, Nagakute (JP); Yasushi Iwata, Nagakute (JP); Jun Yaokawa, Nagakute (JP); Kazuma Hibi, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 144 days.

(21) Appl. No.: 16/268,024

(22) Filed: Feb. 5, 2019

(65) Prior Publication Data

US 2019/0284669 A1 Sep. 19, 2019

(30) Foreign Application Priority Data

Mar. 15, 2018 (JP) ..... JP2018-047692

(51) Int. Cl.
*C22F 1/057* (2006.01)
*C22C 21/14* (2006.01)
(Continued)

(52) U.S. Cl.
CPC ..... *C22F 1/057* (2013.01); *C22C 21/02* (2013.01); *C22C 21/14* (2013.01); *C22C 21/16* (2013.01);
(Continued)

(58) Field of Classification Search
CPC ..... C22F 1/057; C22F 1/043; C22F 1/002; C22C 21/02; C22C 21/14; C22C 21/16; C22C 21/18; B22F 3/15; B22F 3/156
See application file for complete search history.

(56) References Cited

U.S. PATENT DOCUMENTS 3,732,128 A * 5/1973 Statham ..... C22F 1/04 148/666
4,756,680 A * 7/1988 Ishii ..... B22F 3/15 419/49
(Continued)

FOREIGN PATENT DOCUMENTS

CN 101392340 A 3/2009
CN 107675038 A 2/2018
(Continued)

OTHER PUBLICATIONS

Brummer M.; "Heat Treatment of Aluminum Castings Combined with Hot Isostatic Pressing", 12th International Conference on Aluminum Alloys, p. 1095-1100; 2010 (Year: 2010).*

*Primary Examiner* — Duane Smith
*Assistant Examiner* — Austin Pollock
(74) *Attorney, Agent, or Firm* — Oblon, McClelland, Maier & Neustadt, L.L.P.

(57) ABSTRACT

The present disclosure provides a method for manufacturing an aluminum alloy member capable of suppressing deterioration in ductility thereof. In the method for manufacturing an aluminum alloy member, an aluminum alloy casting material that contains 2.0 to 5.5 mass % of Cu, and 4.0 to 7.0 mass % of Si in which a content of Mg is 0.5 mass % or less, a content of Zn is 1.0 mass % or less, a content of Fe is 1.0 mass % or less, a content of Mn is 0.5 mass % or less and the balance is made of Al and inevitable impurities is used. The method for manufacturing an aluminum alloy member includes a heating and holding step of heating and holding
(Continued)

the aluminum alloy casting material within a solid-liquid coexisting temperature region; and a quenching step of rapidly cooling the aluminum ally casting material after performing the heating and holding step.

3 Claims, 15 Drawing Sheets

(51) Int. Cl.

| | |
|---|---|
| ***C22C 21/16*** | (2006.01) |
| ***C22C 21/18*** | (2006.01) |
| ***C22F 1/00*** | (2006.01) |
| ***C22C 21/02*** | (2006.01) |
| ***C22F 1/043*** | (2006.01) |

(52) U.S. Cl.
CPC ..... *C22C 21/18* (2013.01); *C22F 1/002* (2013.01); *C22F 1/043* (2013.01)

(56) References Cited

U.S. PATENT DOCUMENTS

| | | | | |
|---|---|---|---|---|
| 6,719,859 | B2 | 4/2004 | Bergsma | |
| 2001/0023722 | A1* | 9/2001 | Barone | C22F 1/06 148/552 |
| 2003/0155049 | A1 | 8/2003 | Bergsma | |
| 2003/0197295 | A1* | 10/2003 | Nakai | B29C 43/10 264/40.3 |
| 2003/0215539 | A1* | 11/2003 | Manabe | F27B 5/06 425/405.2 |
| 2004/0103964 | A1 | 6/2004 | Nakamura et al. | |
| 2004/0221932 | A1* | 11/2004 | Manabe | C22F 1/04 148/698 |
| 2007/0228596 | A1* | 10/2007 | Fujikawa | B30B 11/002 264/85 |
| 2009/0000495 | A1* | 1/2009 | Graf | B30B 11/002 100/38 |
| 2009/0301682 | A1* | 12/2009 | Proske | B22D 27/04 164/80 |
| 2010/0101691 | A1* | 4/2010 | Doty | C22F 1/043 148/698 |
| 2018/0080108 | A1* | 3/2018 | Morasch | B22D 21/007 |

FOREIGN PATENT DOCUMENTS

| | | | | |
|---|---|---|---|---|
| CN | 107699747 | A | | 2/2018 |
| JP | 55113833 | A | * | 9/1980 |
| JP | 59-215471 | | | 12/1984 |
| JP | 63-188498 | U | | 12/1988 |
| JP | 01092345 | A | * | 4/1989 |
| JP | 02-302587 | | | 12/1990 |
| JP | 11029843 | A | * | 2/1999 |
| JP | 11057965 | A | * | 3/1999 |
| JP | 2004052087 | A | * | 2/2004 |
| JP | 2004-099962 | | | 4/2004 |
| JP | 2017-155288 | | | 9/2017 |

* cited by examiner (Prior Art)

METHOD FOR MANUFACTURING ALUMINUM ALLOY MEMBER

CROSS REFERENCE TO RELATED APPLICATIONS

This application is based upon and claims the benefit of priority from Japanese patent application No. 2018-047692, filed on Mar. 15, 2018, the disclosure of which is incorporated herein in its entirety by reference.

BACKGROUND

The present disclosure relates to a method for manufacturing an aluminum alloy member.

A method for manufacturing an aluminum alloy member in which a casting made of an aluminum alloy containing Si is heated and held to be in a solid-liquid coexistence temperature region under a pressurized environment and then quenched is known. The method is disclosed in Japanese Unexamined Patent Publication No. 2017-155288.

SUMMARY

The inventors of the present disclosure have found the following problems. FIG. 20 is a temperature chart for the method for manufacturing an aluminum alloy member according to the problems to be solved by the present disclosure. The horizontal axis indicates time t, the vertical axis indicates temperature T, and the correspondence between processes and the time t is also shown.

As shown in FIG. 20, in an example of the above-described method for manufacturing an aluminum alloy member, a furnace cooling process is performed in which after heating and holding a casting and before quenching it, the casting is cooled in a furnace to a predetermined temperature $T_S$-ΔT lower than a liquid phase appearance temperature $T_S$. It should be noted that since a cooling rate of the casting in this furnace cooling process is slow, in a metallic structure of an aluminum alloy member, a precipitate containing Si may be coarsened, may be changed from a spherical shape to a clumpy shape, for example, a substantially spheroid shape, a substantially ellipsoidal shape or the like, and coarsening of a grain size of a primary crystal Al may progress. In such a case, there has been a possibility that in a precipitate containing Si, in particular, cleavage is likely to occur so that ductility of an aluminum alloy member decreases.

The present disclosure suppresses deterioration in ductility of an aluminum alloy member.

A first exemplary aspect is a method for manufacturing an aluminum alloy member using an aluminum alloy casting material that contains 2.0 to 5.5 mass % of Cu, and 4.0 to 7.0 mass % of Si, in which a content of Mg is 0.5 mass % or less, a content of Zn is 1.0 mass % or less, a content of Fe is 1.0 mass % or less, a content of Mn is 0.5 mass % or less, and the balance is made of Al and inevitable impurities, and the method for manufacturing an aluminum alloy member includes: a heating and holding step of heating and holding the aluminum alloy casting material within a solid-liquid coexisting temperature region; and a quenching step of rapidly cooling the aluminum ally casting material after performing the heating and holding step, in which in a quenching preparation step between the heating and holding step and the quenching step, the aluminum alloy casting material is rapidly cooled at a cooling rate of 3° C./min or higher from the solid-liquid coexisting temperature region to a predetermined temperature lower than a liquid phase appearance temperature.

With such a structure, a eutectic Si crystallized at the time of casting is divided to be spheroidized, and subsequent coalescence and growth can be suppressed. Accordingly, the eutectic Si is coarsened, and is precipitated in a clumpy shape, such as a substantially spheroid shape, a substantially ellipsoidal shape or the like so that cleavage is prevented from occurring easily. Therefore, deterioration in ductility of an aluminum alloy member can be suppressed.

Further, in the heating and holding step and the quenching preparation step, the aluminum alloy casting material may be placed inside a pressurized furnace so as to be under a pressurized environment.

With such a structure, in the heating and holding step, the aluminum alloy casting material can be heated while applying compressive stress. In the quenching preparation step, likewise, the aluminum alloy casting material can be cooled while applying compressive stress. Accordingly, it is possible to steadily crush blowholes and vacancies that might be contained inside the aluminum alloy casting material. Therefore, deterioration in ductility of an aluminum alloy member can be suppressed.

Further, a nozzle is provided inside the pressurized furnace, and in the quenching preparation step, a cooling gas medium or mist may be blown from the nozzle to cool the aluminum alloy casting material rapidly.

With such a structure, a cooling gas medium removes the heat of the aluminum alloy casting material, or mist removes the same by coming into contact therewith and evaporating it.

Therefore, the aluminum alloy casting material can be cooled while it is placed under a pressurized environment.

Further, a contact part that contacts the aluminum alloy casting material is provided inside the pressurized furnace, the contact part has a shape conforming to a shape of the aluminum alloy casting material, a flow path is provided inside the contact part, and in the quenching preparation step, the aluminum alloy casting material may be rapidly cooled by making a cooling medium flow through the flow path.

With such a structure, the cooling medium removes heat from the aluminum alloy casting material through the contact part so that the aluminum alloy casting material can be rapidly cooled while it is placed under a pressurized environment.

The present disclosure can suppress deterioration in ductility of an aluminum alloy member.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied will be explained hereinafter in detail with reference to the drawings. However, the present disclosure is not limited to the embodiments shown below. Further, for clarifying the explanation, the following descriptions and the drawings are simplified as appropriate. In FIGS. 3 to 6, right-handed three-dimensional xyz orthogonal coordinates are defined. As a matter of course, the right-handed xyz coordinates shown in FIG. 3 and other drawings are shown only for the sake of convenience to explain positional relations among components. Normally, the z-axis positive direction is a vertically upward direction, and the xy-plane is a horizontal plane, which direction and plane are the same throughout the drawings.

First Embodiment

Figure 1:
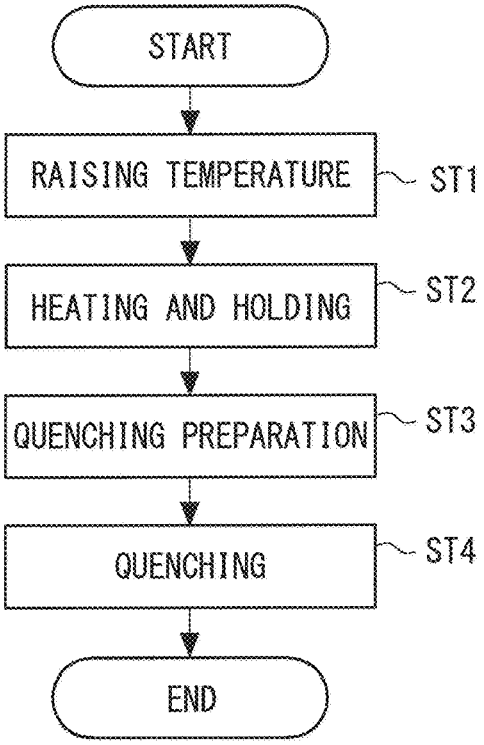
FIG. 1 is a flowchart of a method for manufacturing an aluminum alloy member according to a first embodiment.
Figure 2:
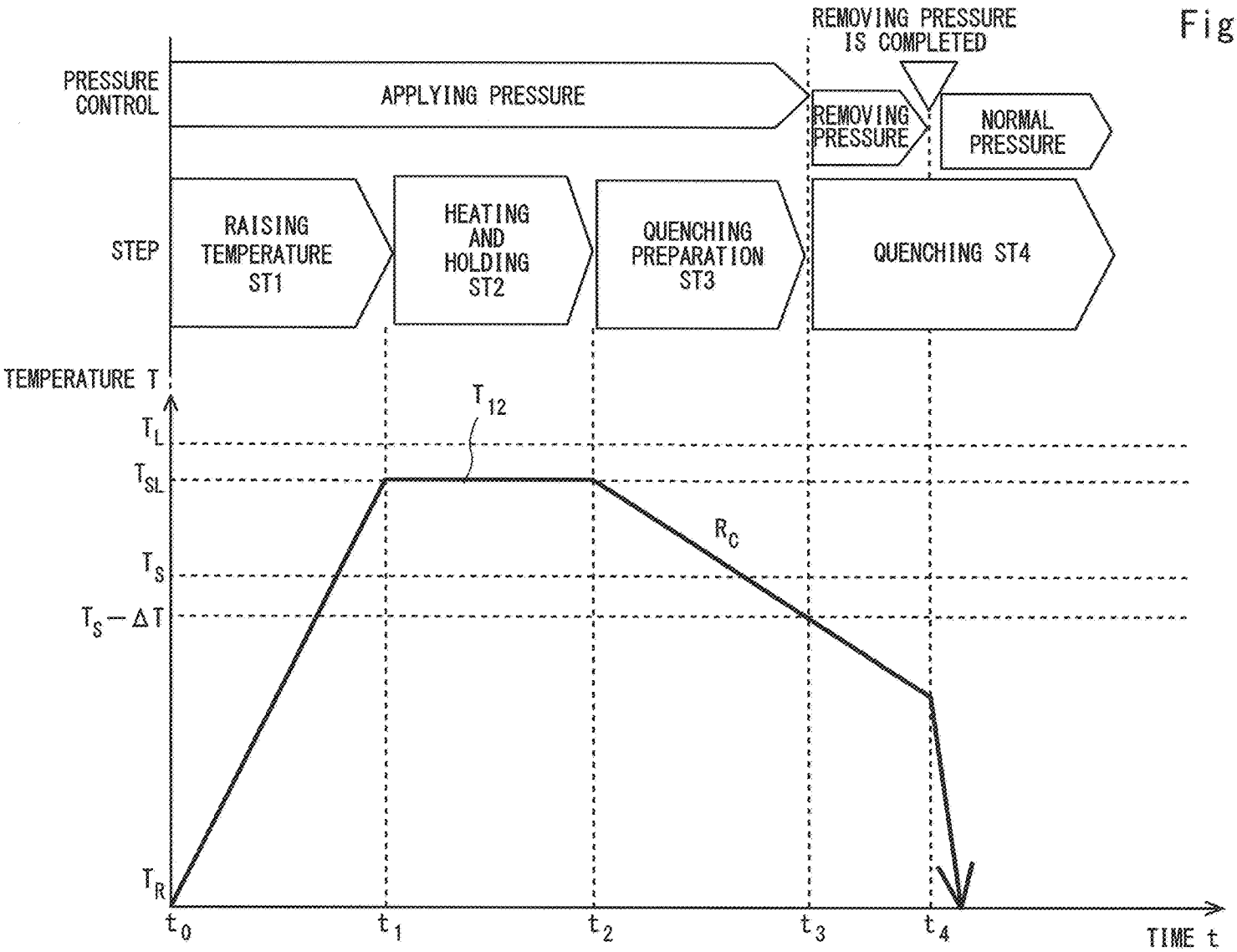
FIG. 2 is a temperature chart of the method for manufacturing an aluminum alloy member according to the first embodiment.

A method for manufacturing an aluminum alloy member according to a first embodiment is described with reference to FIGS. 1 and 2. FIG. 1 is a flowchart of the method for manufacturing an aluminum alloy member according to the first embodiment. FIG. 2 is a temperature chart of the method for manufacturing an aluminum alloy member according to the first embodiment. The horizontal axis indicates time t and the vertical axis indicates temperature T, and the correspondence between the time t and pressure control and the correspondence between steps ST1 to ST4 shown in FIG. 1 and the time t are also shown.

First, as shown in FIGS. 1 and 2, an aluminum alloy casting material is heated to raise the temperature until it falls within a solid-liquid coexisting temperature region $T_S$ to $T_1$, (temperature-raising step ST1). In other words, the solid-liquid coexisting temperature region $T_S$ to $T_L$ is a temperature region within a range of from a liquid phase appearance temperature $T_S$ to a liquidus temperature $T_L$. Further, in the temperature-raising step ST1, a pressure is applied to the aluminum alloy casting material by increasing a pressure in a space where the aluminum alloy casting material is placed.

Next, the aluminum alloy casting material is heated and held during heating and holding time $t_1$ to $t_2$ so that an aluminum alloy casting material temperature $T_{12}$ is maintained at a predetermined temperature within the solid-liquid coexisting temperature region $T_S$ to $T_L$ (heating and holding step ST2). Further, in the heating and holding step ST2, the pressure is continuously applied to the aluminum alloy casting material starting from the temperature-raising step ST1 described above.

Subsequently, the aluminum alloy casting material is cooled at a cooling rate Rc until the temperature thereof becomes a temperature $T_S$-ΔT lower than the liquid phase appearance temperature $T_S$ by a predetermined differential temperature ΔT from a predetermined temperature within the solid-liquid coexisting temperature region $T_S$ to $T_L$ (quenching preparation step ST3). Lastly, the aluminum alloy casting material is further cooled to a normal temperature $T_R$ after the pressure of the space where the aluminum alloy casting material is placed is removed to reach the normal pressure (atmospheric pressure) (quenching step ST4).

Note that in the above quenching step ST4 of the method for manufacturing an aluminum alloy member according to the first embodiment, although the pressure of the space where the aluminum alloy casting material is placed starts to be removed from the start of the quenching step ST4, the start of removing the pressure may be within a range of from the middle of the quenching preparation step ST3 in which the aluminum alloy casting material is rapidly cooled to the liquid phase appearance temperature $T_S$ or lower to the completion of the quenching step ST4.

(One Specific Example of Method for Manufacturing Aluminum Alloy Member According to First Embodiment)

Figure 3:
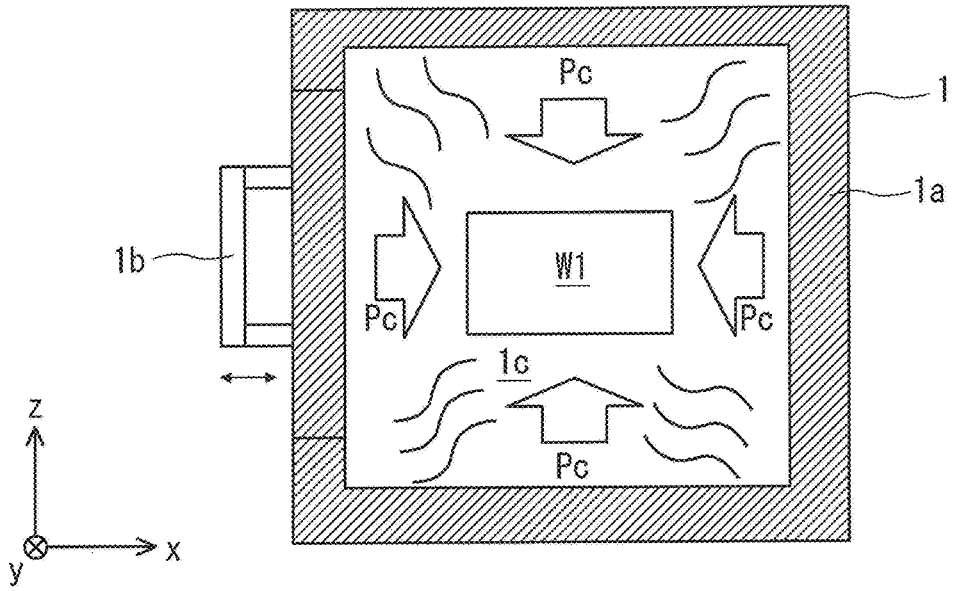
FIG. 3 is a schematic diagram showing a temperature-raising step, and a heating and holding step for the method for manufacturing an aluminum alloy member according to the first embodiment.
Figure 4:
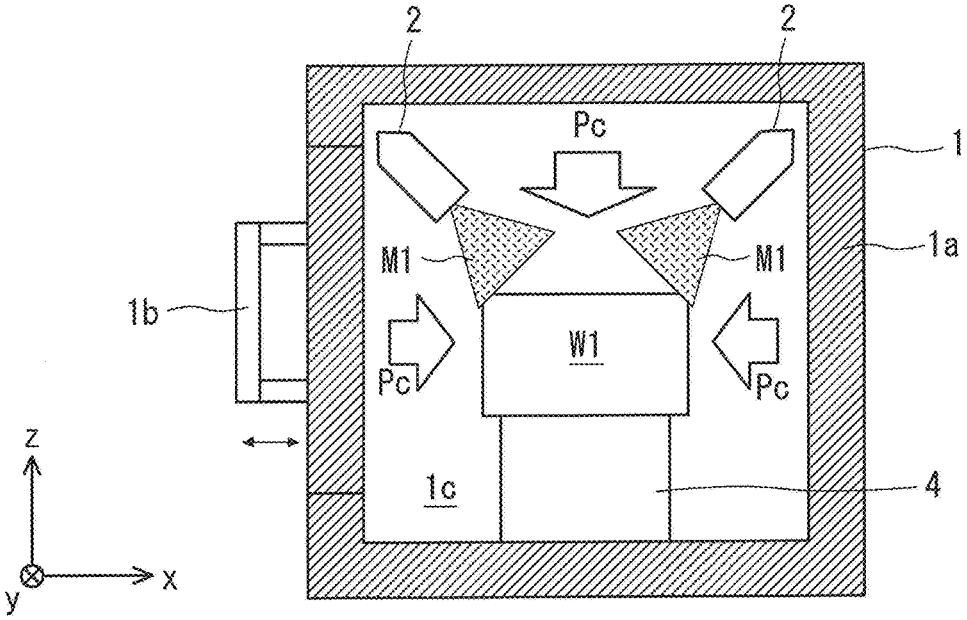
FIG. 4 is a schematic diagram showing an example of a quenching preparation step of the method for manufacturing an aluminum alloy member according to the first embodiment.
Figure 5:
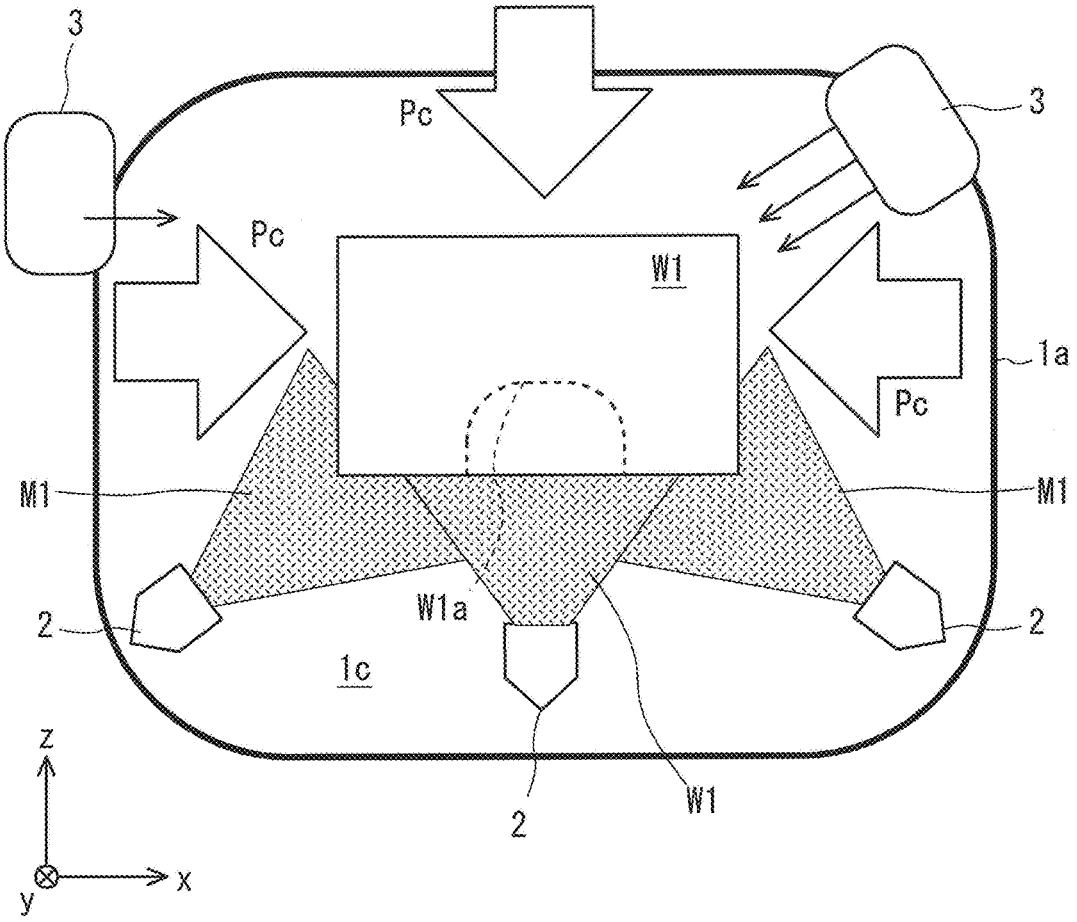
FIG. 5 is a schematic diagram showing a modified example of the quenching preparation step of the method for manufacturing an aluminum alloy member according to the first embodiment.
Figure 6:
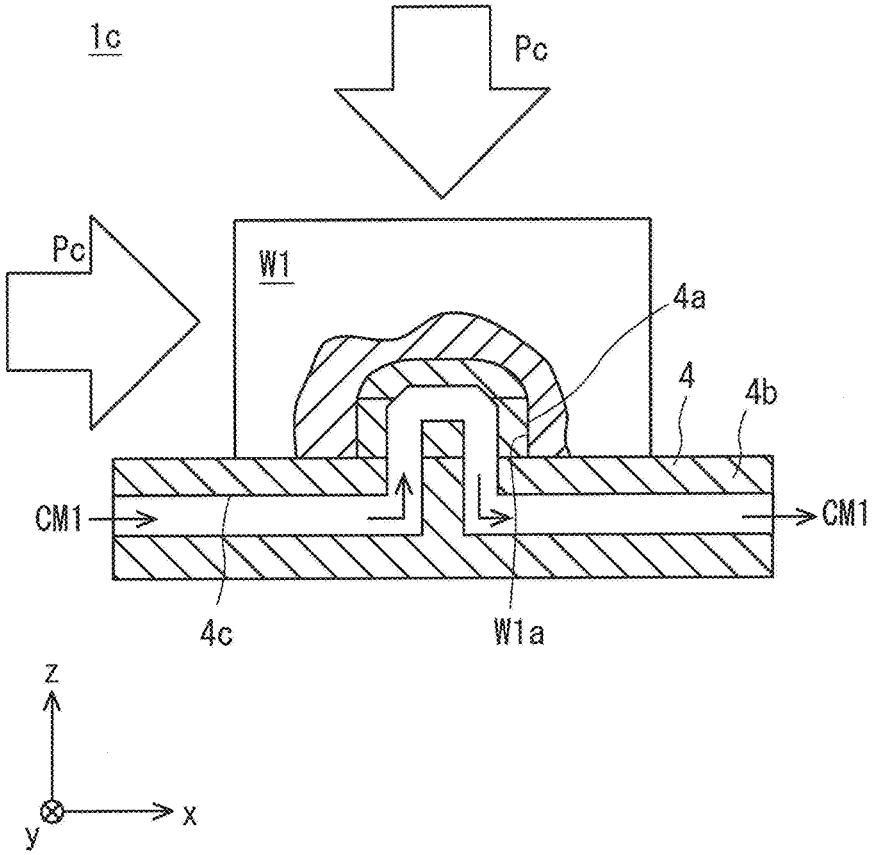
FIG. 6 is a schematic diagram showing another modified example of the quenching preparation step of the method for manufacturing an aluminum alloy member according to the first embodiment.

Next, a specific example of the above-described method for manufacturing an aluminum alloy member is described with reference to FIGS. 3 to 6. FIG. 3 is a schematic diagram showing the temperature-raising step, and the heating and holding step for the method for manufacturing an aluminum alloy member according to the first embodiment. FIG. 4 is a schematic diagram showing an example of the quenching preparation step of the method for manufacturing an aluminum alloy member according to the first embodiment. FIG. 5 is a schematic diagram showing a modified example of the quenching preparation step of the method for manufacturing an aluminum alloy member according to the first embodiment. Note that in FIGS. 3 and 5, a support base 4 is omitted for an illustration purpose. FIG. 6 is a schematic diagram showing another modified example of the quenching preparation step of the method for manufacturing an aluminum alloy member according to the first embodiment.

(One Specific Example of Temperature-Raising Step ST1)

First, a specific example of the temperature-raising step ST1 is described with reference to FIG. 3. As shown in FIG. 3, an aluminum alloy casting material W1 is heated to raise the temperature thereof by using a pressurized furnace 1. The pressurized furnace 1 includes a main body 1*a* having an internal space 1*c* capable of accommodating the aluminum alloy casting material W1, and a door 1*b* that opens and closes the main body 1*a*.

The aluminum alloy casting material W1 is formed by melting an aluminum alloy, filling it to a mold, and solidifying it. The aluminum alloy casting material W1 has a predetermined shape, and is a part used for, for example, a vehicle. Examples of such parts include various parts such as an underbody member, and a wheel member, in addition to parts for engines such as a cylinder head. This aluminum alloy contains 2.0 to 5.5 mass % of Cu, and 4.0 to 7.0 mass % of Si, in which a content of Mg is 0.5 mass % or less, a content of Zn is 1.0 mass % or less, a content of Fe is 1.0 mass % or less, a content of Mn is 0.5 mass % or less and the balance is made of Al and inevitable impurities. Details of the chemical composition of the aluminum alloy will be described later.

Specifically, in the temperature-raising step ST1, the pressurized furnace 1 is hermetically sealed while the aluminum alloy casting material W1 is placed on the support base 4 (see FIG. 4) in the internal space 1*c* of the pressurized furnace 1, and then the temperature therein is raised. Applying a pressure may be started together with this temperature-raising. It is preferred that a pressure be applied to the internal space 1*c* so that the pressure thereof becomes a predetermined furnace pressure Pc, and after reaching the predetermined furnace pressure Pc, that the furnace pressure Pc be maintained. When the furnace pressure Pc is maintained, the aluminum alloy casting material W1 is heated and the temperature thereof is raised while being under a predetermined pressurized environment. The furnace pressure Pc [MPa] may be any value as long as burning (melting) does not occur in the aluminum alloy casting material W1 or a sweating phenomenon in which melt is jetted in the surface of the casting does not occur, and may be, for example, preferably 0.6 MPa or higher.

(One Specific Example of Heating and Holding Step ST2)

A specific example of the heating and holding step ST2 is described also with reference to FIG. 3. As shown in FIG. 3, by using the pressurized furnace 1, the aluminum alloy casting material W1 is heated and held during the heating and holding time $t_1$ to $t_2$ so that an aluminum alloy casting material W1 temperature $T_{12}$ is maintained within the solid-liquid coexisting temperature region $T_S$ to $T_L$ (heating and holding step ST2).

Specifically, together with this heating and holding of the aluminum alloy casting material W1, in the heating and holding step ST2, the pressure is continuously applied to the internal space 1*c* of the pressurized furnace 1 so that the furnace pressure Pc therein is maintained within a range of predetermined pressurized values. Since the aluminum alloy casting material W1 temperature $T_{12}$ is maintained within the solid-liquid coexisting temperature region $T_S$ to $T_L$, the pressure is applied to a blowhole through a liquid phase. Then, hydrogen in the blowhole is dissolved in an Al phase, and the size of the blowhole is reduced. As the pressure increases, the aluminum alloy casting material W1 is softened and then the internal defects thereof are crushed by receiving a compressive stress due to the furnace pressure Pc. These internal defects are, for example, vacancies and blowholes. The aluminum alloy casting material W1 temperature $T_{12}$ is preferably within the solid-liquid coexisting temperature region $T_S$ to $I_L$, and it is also preferred that a heating and holding temperature $T_{SL}$ be constant. It is preferred that the furnace pressure Pc be 0.6 Mpa or higher, or the heating and holding temperature $T_{SL}$ be the liquidus temperature $T_L$ or lower. This is because burning (melting) in the aluminum alloy casting material W1, or a sweating phenomenon in which melt is jetted in the surface of the casting, is less likely to occur at this pressure/temperature. The heating and holding temperature $T_{SL}$ is preferably the liquid phase appearance temperature $T_S$ or higher since the eutectic Si is divided and the spheroidizing thereof progresses.

(One Specific Example of Quenching Preparation Step ST3)

Next, a specific example of the quenching preparation step ST3 is described with reference to FIG. 4. As shown in FIG. 4, the aluminum alloy casting material W1 is cooled at a cooling rate Rc until the temperature thereof becomes a temperature $T_S$-ΔT lower than the liquid phase appearance temperature $T_S$ by a predetermined differential temperature ΔT from a predetermined temperature within the solid-liquid coexisting temperature region $T_S$ to $T_L$ (quenching preparation step ST3).

The cooling rate Rc is 3° C./min or higher. The differential temperature ΔT [° C.] may be 0 (zero) ° C. or higher, and may be, for example, 5° C., 10° C., 15° C., 20° C., or 25° C. or lower. The aluminum alloy casting material W1 is cooled at the cooling rate Rc of 3° C./min or higher until the temperature thereof becomes a temperature $T_S$-ΔT lower than the liquid phase appearance temperature $T_S$ by a predetermined differential temperature ΔT from within the solid-liquid coexisting temperature region $T_S$ to $T_L$. Note that when the temperature of the aluminum alloy casting material W1 is maintained within the solid-liquid coexisting temperature region $T_S$ to $T_L$, in the metallic structure of the aluminum alloy casting material W1, the eutectic Si tends to become coarse or clumpy. On the other hand, when the temperature of the aluminum alloy casting material W1 is maintained at a temperature lower than the liquid phase appearance temperature $T_S$, the eutectic Si tends to be less likely to become coarse or clumpy, and tends to maintain a fine and spherical shape. Therefore, the above-described cooling rate is maintained and thereby the temperature of the aluminum alloy casting material W1 drops to a temperature lower than the liquid phase appearance temperature $T_S$ before the eutectic Si becomes coarse or clumpy. This allows the eutectic Si to maintain a fine and spherical shape.

Specifically, in the quenching preparation step ST3, as shown in FIG. 4, mist M1 is blown on the aluminum alloy casting material W1 from mist nozzles 2 while the aluminum alloy casting material W1 remains placed on the support base 4 in the internal space 1*c* of the pressurized furnace 1. The mist M1 is vaporized to remove heat from the surface of the aluminum alloy casting material W1.

Further, subsequent to the heating and holding step ST2, in the quenching preparation step ST3 it is preferred that the pressure be continuously applied to the internal space 1*c* of the pressurized furnace 1 so that the furnace pressure Pc therein is maintained within a range of predetermined pressurized values. The furnace pressure Pc is preferably maintained at a predetermined value, for example, 0.6 MPa or higher defects on the surface of the aluminum alloy casting material W1 due to a sweating phenomenon or burning (melting) in the aluminum alloy casting material W1 are less likely to occur at this value.

The mist nozzles 2 are connected to a tank (not shown) or the like that stores the fluid through a flow path (not shown), and the fluid is appropriately supplied to the mist nozzles 2 through a valve (not shown) or the like. The mist nozzles 2, the tank, the valve, and the flow path may be configured by using a mist spray device (not shown).

(One Modified Example of Quenching Preparation Step ST3)

Next, a modified example of the quenching preparation step ST3 is described with reference to FIG. 5. There is a modified example of the quenching preparation step ST3 shown in FIG. 5. As shown in FIG. 5, while the aluminum alloy casting material W1 is supported by the support base 4 (see FIG. 4), a cooling gas medium, for example, air may be blown on the aluminum alloy casting material W1 from fluid nozzles 3.

Specifically, in this modified example of the quenching preparation step ST3, when the aluminum alloy casting material W1 is a cylinder head, air is preferably blown on the vicinity of the center of the chamber of that cylinder head. The fluid nozzles 3 can blow a fluid, such as air, water, nitrogen (N2), helium (He), argon (Ar), or the like, as a cooling gas medium on the aluminum alloy casting material W1. The support base 4 (see FIG. 4) may have a structure such that the mist M1 blown from the mist nozzle 2 passes therethrough to come into contact with the aluminum alloy casting material W1. Further, as necessary, the blowing of the mist M1 by the mist nozzle 2 may be stopped and merely the blowing of the fluid by the fluid nozzles 3 may be performed.

(Another Modified Example of Quenching Preparation Step ST3)

Next, another modified example of the quenching preparation step ST3 is described with reference to FIG. 6. There is another modified example of the quenching preparation step ST3 shown in FIG. 6. As shown in FIG. 6, while the aluminum alloy casting material W1 is supported by the support base 4, a cooling medium CM1 may be flowed through a flow path 4*c* in the support base 4 to cool the aluminum alloy casting material W1.

Specifically, in another modified example of the quenching preparation step ST3, the support base 4 includes a contact part 4*a*, a base 4*b* that supports the contact part 4*a*, and the flow path 4*c* through which the cooling medium CM1 can flow. It is preferred that the contact part 4*a* have a shape conforming to that of the aluminum alloy casting material W1, and be capable of coming into surface contact with the aluminum alloy casting material W1. The support base 4 is preferably made of a material having a thermal conductivity higher than that of other components of the pressurized furnace 1. Examples of such materials include Cu (copper), or Cu alloy.

As the cooling medium CM1, for example, water, oils, or the like can be used. In order to supply and discharge the cooling medium CM1 to and from the flow path 4*c*, a tank (not shown), an ejection device (not shown), or the like are preferably connected to the flow path 4*c*.

When an example of the aluminum alloy casting material W1 shown in FIG. 6 includes a concave curved-surface part W1*a*, the contact part 4*a* has a convex curved-surface part conforming to the concave curved-surface part W1*a*. The flow path 4*c* in the support base 4 preferably extends inside thereof so as to cross the aluminum alloy casting material W1.

When the aluminum alloy casting material W1 and the contact part 4*a* of the support base 4 are brought to come into surface contact with each other, the contact part 4*a* removes heat from the aluminum alloy casting material W1 to cool the same. Further, when the cooling medium CM1 is supplied to the flow path 4*c* while the aluminum alloy casting material W1 and the contact part 4*a* are in surface contact with each other, the cooling medium CM1 removes heat from the aluminum alloy casting material W1 through the contact part 4*a* to cool the same. Note that it has been described that as the quenching preparation step ST3, a specific example of the quenching preparation step ST3 shown in FIG. 4, a modified example of the quenching preparation step ST3 shown in FIG. 5, and another modified example of the quenching preparation step ST3 shown in FIG. 6 can be used. As necessary, any one of these steps may be used and two or all of them in combination may be used as the quenching preparation step ST3.

(One Specific Example of Quenching Step ST4)

Next, a specific example of the quenching step ST4 is described. The aluminum alloy casting material W1 is further cooled to a normal temperature $T_R$ (quenching step ST4).

Specifically, in the quenching step ST4, after the removal of the pressure in the internal space 1*c* of the pressurized furnace 1 is started and the internal space 1*c* is confirmed to be at normal pressure (atmospheric pressure), the door 1*b* is opened so that the aluminum alloy casting material W1 can be taken outside the pressurized furnace 1, and the aluminum alloy casting material W1 is submerged in a water tank or the like to cool it rapidly.

Further, in the quenching step ST4, the aluminum alloy casting material W1 may be cooled by using the cooling method used in the quenching preparation step ST3 while the aluminum alloy casting material W1 is placed on the support base 4 in the internal space 1*c* of the pressurized furnace 1 continuously from the quenching preparation step ST3.

Note that in the example of the quenching step ST4, although the pressure starts to be removed from the internal space 1*c* of the pressurized furnace 1 from the start of the quenching step ST4, removal of the pressure from the internal space 1*c* of the pressurized furnace 1 may be started from the middle of the quenching preparation step ST3. The pressure is preferably removed in such a manner since the aluminum alloy casting material W1 can be rapidly cooled by submerging it in a water tank or the like and thereby the quenching step ST4 is shortened. Note that it is conceivable that the aluminum alloy member can maintain the shape or the like necessary for a desired aluminum alloy member even though defects due to burning and sweating phenomenon are likely to occur when the pressure is removed in such a manner. One reason for this is that since liquid phases which appeared at the liquid phase appearance temperature $T_S$ contain a lot of substances solidified in a non-equilibrium state, most of the liquid phases are dissolved in Al phases by carrying out the heating and holding step ST2. That is, the removal of the pressure from the internal space 1*c* of the pressurized furnace 1 may be started in the middle of the quenching preparation step ST3 in which the aluminum alloy member maintains the characteristic, the shape, or the like necessary for a desired aluminum alloy member, and in particular, the temperature of the aluminum alloy casting material W1 is preferably in the vicinity of the liquid phase appearance temperature $T_S$.

As described above, since the cooling rate of the aluminum alloy casting material W1 in the quenching preparation step ST3 is 3° C./min, coalescence and coarsening of the eutectic Si are suppressed in the metallic structure of the aluminum alloy casting material W1. Therefore, the eutectic Si can maintain the fine and spherical shape. Accordingly, deterioration in ductility of an aluminum alloy member can be suppressed.

(Chemical Composition)

Next, a content of each component in the chemical composition of the aluminum alloy casting material W1 is described. When a content of Si in the chemical composition of the aluminum alloy casting material W1 is within a suitable range, a predetermined castability can be achieved. Accordingly, casting defects such as cracks and shrinkage cavities are less likely to occur in the aluminum alloy casting material W1 On the other hand, when the content of Si is too large, a large number of brittle Si particles crystallize in the aluminum alloy casting material W1, and thereby mechanical properties such as a breaking elongation and strength are likely to deteriorate. Therefore, the content of Si is preferably within a range of from 4.0% to 7.0%. The upper limit thereof is preferably any one of 6.5%, 6.0%, and 5.5%. The lower limit thereof is preferably any one of 4.5%, 5.0%, and 5.5%.

Further, when a content of Cu is within a suitable range, by heat treatment, $CuAl_2$ is sometimes precipitated in the metallic structure of the aluminum alloy casting material W1, or an MgCu-based compound is sometimes precipitated therein when Mg coexists in Al. In this way, mechanical strengths of Al, such as a tensile strength and 0.2% proof stress, can be improved. On the other hand, when the content of Cu is too large, ductility and toughness of the aluminum alloy casting material W1 may decrease. Therefore, the content of Cu is preferably within a range of from 2.0% to 5.5%. The upper limit thereof is preferably any one of 5.0%, 4.5%, and 4.0%. The lower limit thereof is preferably any one of 2.5%, 3.0%, 3.5%, 4.0% and 4.5%.

Further, when a content of Mg is within a suitable range, Mg atoms are dissolved in an Al base and thereby can strengthen the Al base. Further, Mg precipitates as $Mg_2Si$ by heat treatment, and thereby mechanical strengths, such as a tensile strength and 0.2% proof stress, of the aluminum alloy member can be improved. When the content of Mg is too large, ductility and toughness of the aluminum alloy casting material W1 may decrease. Therefore, the content of Mg is preferably 0.5% or less. Further, the content of Mg may be within a range of from 0.2% to 0.4%.

Further, when contents of Zn and Fe are too large, ductility and toughness of the aluminum alloy casting material W1 may decrease. Therefore, the contents of Zn and Fe are preferably 1.0% or less, respectively.

Further, when a content of Mn is within a suitable range, adverse effects of Fe on the aluminum alloy casting material W1 may be reduced. Further, a content of Mn is too large, ductility and toughness of the aluminum alloy casting material W1 may decrease. Therefore, the content of Mn is preferably 0.5% or less. Further, the content of Mn may be within a range of from 0.2% to 0.4%.

Note that in addition to the above-described components, for example, Sr, Na, Sb, Ti, B and the like may be contained in the aluminum alloy casting material W1. By containing the above-described component elements in this material, a eutectic Si or a primary crystal α-Al in the aluminum alloy casting material W1 is made fine, etc. so that the mechanical strength of the aluminum alloy casting material W1 can be improved. Further, as necessary, the aluminum alloy casting material W1 may modify the metallic structure by containing component elements other than those described above.

An aluminum alloy corresponding to the above-described chemical composition of the aluminum alloy casting material W1 is, for example, an AC2-type alloy defined by the JIS standard. The AC2-type alloys are, for example, AC2A, AC2B, AC2H or the like.

EXAMPLE (Verification Experiment 1 on Cooling Rate)

Next, a verification experiment on a cooling rate is described. As an aluminum alloy casting material, a rectangular parallelepiped test piece made of an alloy corresponding to AC2B was used. The size of the rectangular parallelepiped test piece is 30 mm in width, 95 mm in depth, and 35 mm in height.

In an example 1, this rectangular parallelepiped test piece was rapidly cooled in a quenching preparation step having the structure same as that of the specific example of the quenching preparation step ST3 (see FIG. 4) in the method for manufacturing an aluminum alloy member according to the first embodiment described above. Specifically, in this quenching preparation step, only a nozzle having the same configuration as that of the fluid nozzle 3 (see FIGS. 4 and 5) was used to cool this rectangular parallelepiped test piece rapidly. This nozzle is extended so as to surround the rectangular parallelepiped test piece, and has a plurality of spray ports, which blow nitrogen ($N_2$) on the rectangular parallelepiped test piece. The flow rate of nitrogen was 65 L/min.

In a comparative example 1, this rectangular parallelepiped test piece was rapidly cooled in a quenching preparation step having the structure same as that of the example 1 other than the nozzles. The nozzle which was used in the comparative example 1 has one spray port, which blows nitrogen on this rectangular parallelepiped test piece. The flow rate of nitrogen blown from the nozzles in the comparative example 1 was respectively 3 L/min.

Figure 7:
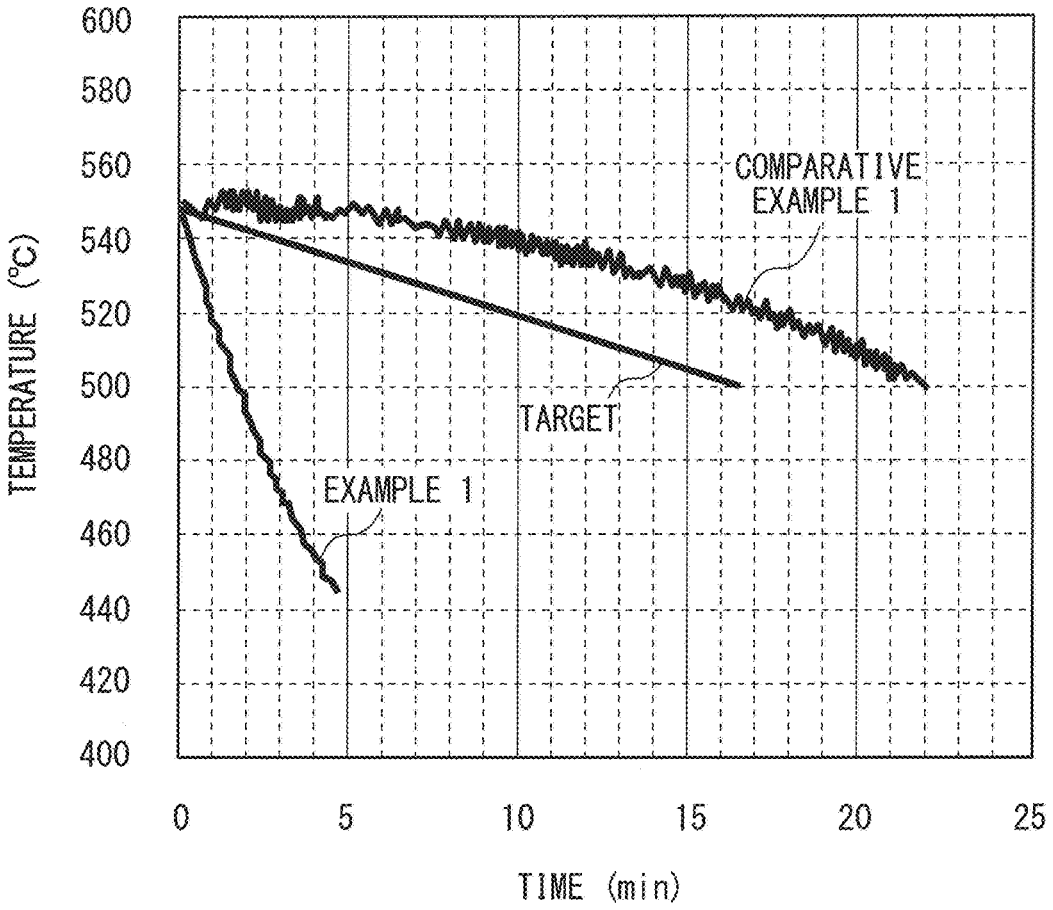
FIG. 7 is a graph showing a temperature of an aluminum alloy casting material with respect to time elapsed in the quenching preparation step.

FIG. 7 is a graph showing a temperature of an aluminum alloy casting material with respect to time elapsed in the quenching preparation step. The vertical axis indicates a temperature of the aluminum alloy casting material [° C.], and the horizontal axis indicates an elapsed time [min] in the quenching preparation step. As shown in FIG. 7, in the example 1, the cooling rate greatly exceeded the target cooling rate of 3° C./min, whereas in the comparative example 1, the cooling rate was significantly lower than the target cooling rate of 3° C./min.

(Verification Experiment 2 on Cooling Rate)

Next, another verification experiment on a cooling rate is described. As an aluminum alloy casting material, a cylinder head made of an alloy corresponding to AC2B was used. This cylinder head includes one cylinder and was used for this verification experiment.

In an example 2, this cylinder head was rapidly cooled in a quenching preparation step having the structure same as that of another modified example of the quenching preparation step ST3 (see FIG. 6) in the method for manufacturing an aluminum alloy member according to the first embodiment described above. Specifically, in the quenching preparation step, a support base having the same configuration as that of the support base 4 (see FIGS. 4 and 6) was used to cool this cylinder head rapidly. This support base is made of a Cu alloy, and the contact part thereof has a shape conforming to a chamber of the cylinder head. When this cylinder head is supported by this support base, they come into surface contact with each other. Water was used as a cooling medium flowing through the flow path in this support base.

In a comparative example 2, this cylinder head was rapidly cooled in a quenching preparation step having the structure same as that of the example 2 other than the support base. The support base which was used in the comparative example 2 has the configuration same as that of the support base which was used in the example 2 except that it is made of a cast iron, specifically, a material corresponding to FC250 defined by the JIS standard.

Figure 8:
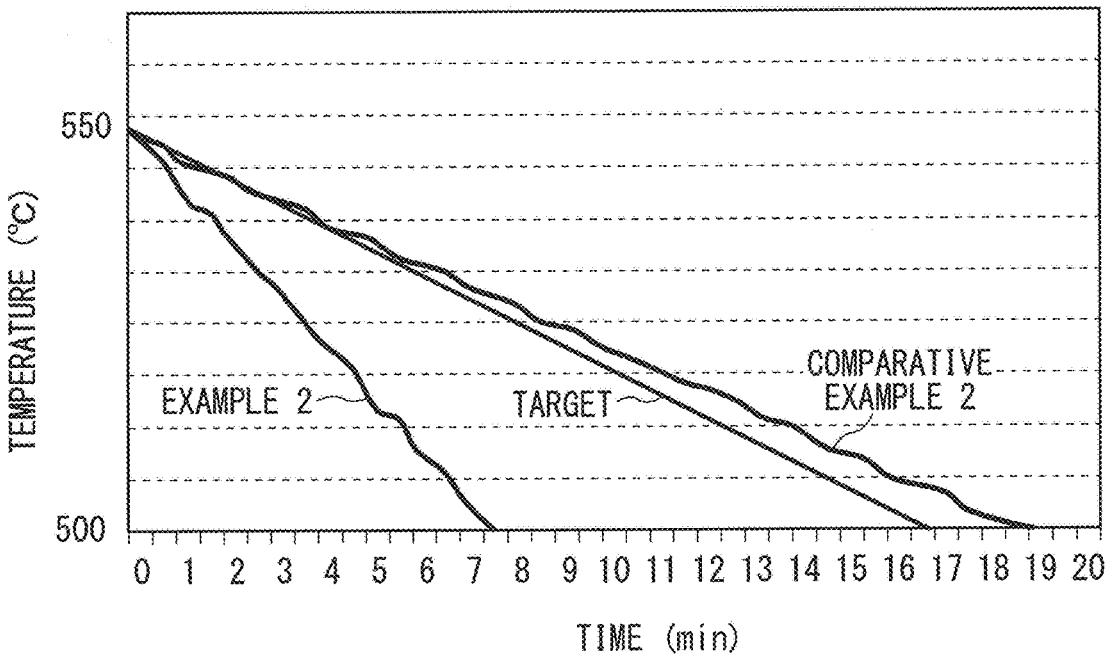
FIG. 8 is a graph showing a temperature of an aluminum alloy casting material with respect to time elapsed in the quenching preparation step.

FIG. 8 is a graph showing a temperature of an aluminum alloy casting material with respect to time elapsed in the quenching preparation step. The vertical axis indicates a temperature of the aluminum alloy casting material [° C.], and the horizontal axis indicates an elapsed time [min] in the quenching preparation step. As shown in FIG. 8, in the example 2, the cooling rate was higher than the target cooling rate of 3° C./min. On the other hand, in the comparative example 2, the cooling rate was lower than the target cooling rate of 3° C./min.

(Verification Experiment in Each Manufacturing Condition)

Next, an experiment using a method for manufacturing an aluminum alloy member which was carried out to find manufacturing conditions suitable for the above-described method for manufacturing an aluminum alloy member according to the first embodiment is described. The method for manufacturing an aluminum alloy member which was used in this experiment is the same as the above-described method for manufacturing an aluminum alloy member according to the first embodiment other than the furnace pressure Pc, the heating and holding time $t_1$ to $t_2$ in the heating and holding step ST2, the aluminum alloy casting material W1 temperature $T_{12}$, and the cooling rate Rc in the quenching preparation step ST3.

Specifically, an AC2B-type alloy was used as an aluminum alloy casting material. In the atmosphere, this aluminum alloy casting material was formed by naturally cooling and solidifying a molten metal made of an AC2B-type alloy after pouring it into a mold (JIS No. 7) having a boat-shaped cavity. In a heating and holding step corresponding to the heating and holding step ST2, a heating and holding time $t_1$ to $t_2$ (see FIGS. 1 and 2) [min] was set between 0 and 15 minutes, an aluminum alloy casting material W1 temperature $T_{12}$ was set to a predetermined heating and holding temperature $T_{SL}$ [° C.], and the heating and holding temperature $T_{SL}$ was set between 510 and 560° C. In a quenching preparation step corresponding to the quenching preparation step ST3, a cooling rate Rc [° C./min] was set between 0 and 15° C./min. A furnace pressure Pc [MPa] before removal of a pressure is started between a temperature-raising step corresponding to the temperature-raising step ST1 and a quenching step was set between 0.1 and 1.0 MPa.

0.2% proof stress and a breaking elongation were measured for each of the aluminum alloy member test pieces which were manufactured as described above. FIGS. 9, 11, 13 and 15 show the results of each of the measurements.

Figure 9:
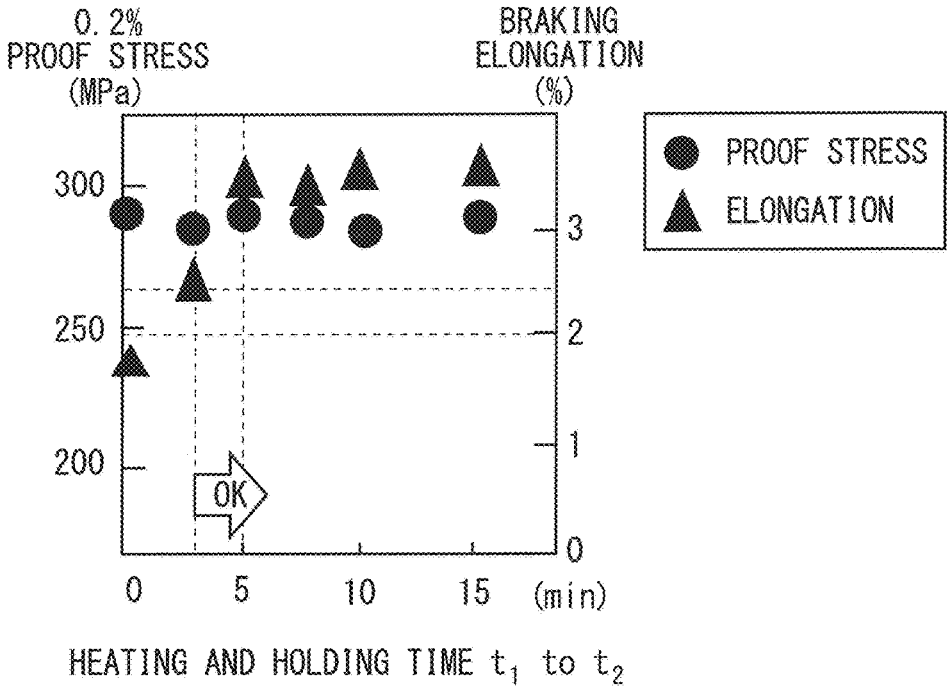
FIG. 9 is a graph showing 0.2% proof stress and a breaking elongation with respect to a heating and holding time.

Specifically, first, the 0.2% proof stress and the breaking elongation with respect to the heating and holding time $t_1$ to $t_2$ were shown in FIG. 9. FIG. 9 is a graph showing the 0.2% proof stress and the breaking elongation with respect to the heating and holding time. The vertical axis indicates the 0.2% proof stress and the breaking elongation of the aluminum alloy member test piece, and the horizontal axis indicates the heating and holding time $t_1$ to $t_2$ in the heating and holding step.

Figure 11:
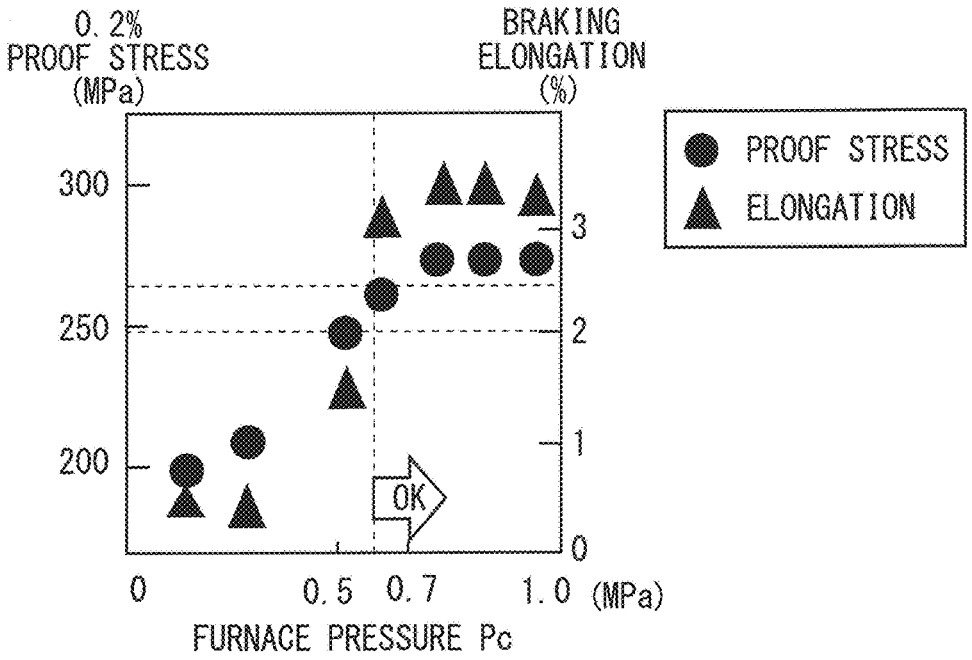
FIG. 11 is a graph showing 0.2% proof stress and a breaking elongation with respect to a furnace pressure.

Further, the 0.2% proof stress and the breaking elongation with respect to the furnace pressure were shown in FIG. 11. FIG. 11 is a graph showing the 0.2% proof stress and the breaking elongation with respect to the furnace pressure. The vertical axis indicates the 0.2% proof stress and the breaking elongation of the aluminum alloy member test piece, and the horizontal axis indicates the furnace pressure Pc before removal of a pressure is started between the temperature-raising step and the quenching step.

Figure 13:
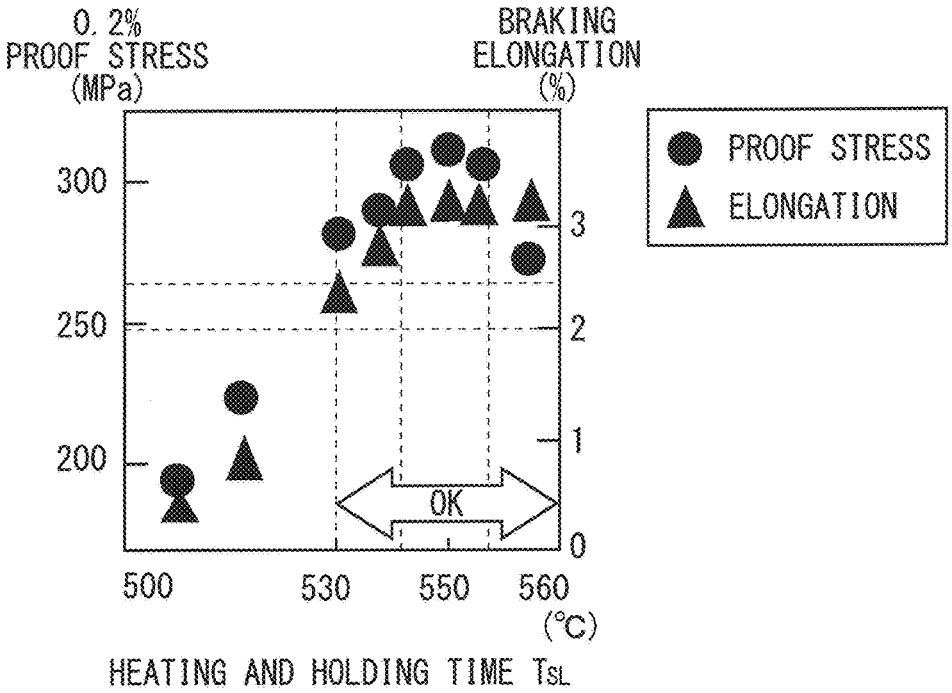
FIG. 13 is a graph showing 0.2% proof stress and a breaking elongation with respect to heating and holding temperature.

Further, the 0.2% proof stress and the breaking elongation with respect to the heating and holding temperature of the aluminum alloy casting material W1 were shown in FIG. 13. FIG. 13 is a graph showing the 0.2% proof stress and the breaking elongation with respect to the heating and holding temperature. The vertical axis indicates the 0.2% proof stress and the breaking elongation of the aluminum alloy member test piece, and the horizontal axis indicates the heating and holding temperature $T_{SL}$ in the heating and holding step.

Figure 15:
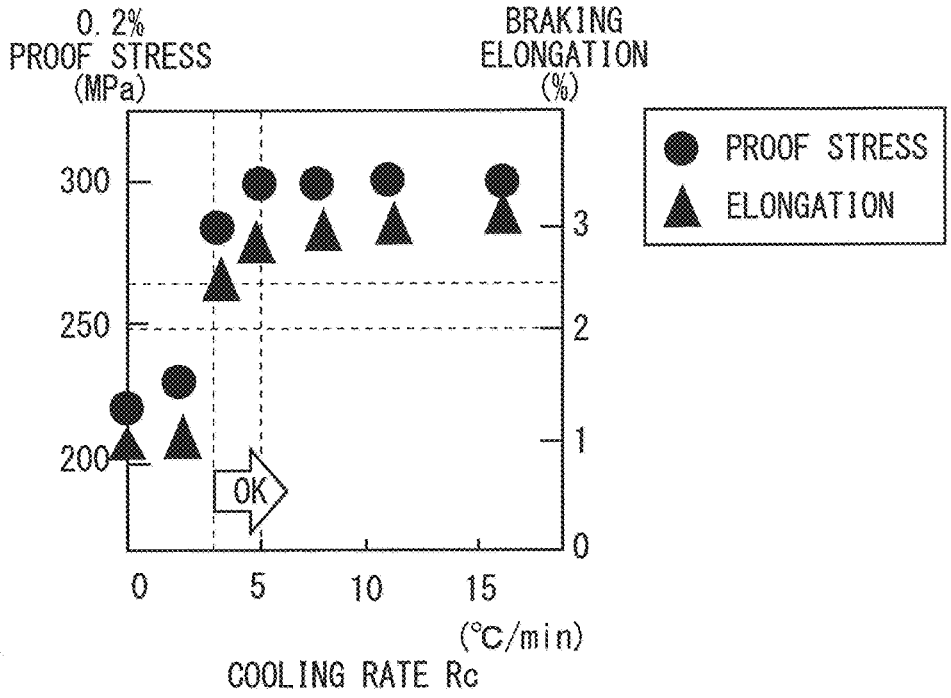
FIG. 15 is a graph showing 0.2% proof stress and a breaking elongation with respect to a cooling rate.

Further, the 0.2% proof stress and the breaking elongation with respect to the cooling rate were shown in FIG. 15. FIG. 15 is a graph showing the 0.2% proof stress and the breaking elongation with respect to the cooling rate. The vertical axis indicates the 0.2% proof stress and the breaking elongation of the aluminum alloy member test piece, and the horizontal axis indicates the cooling rate Rc in the quenching preparation step.

Figure 10:
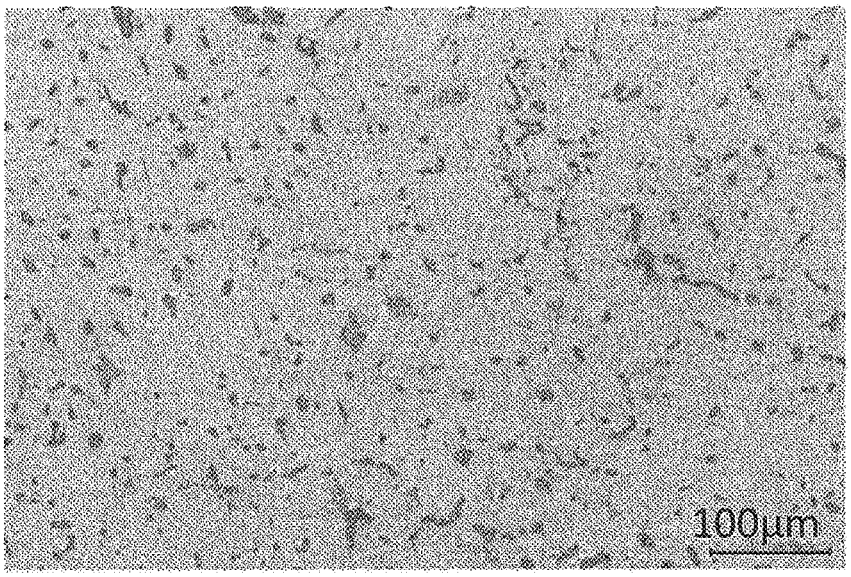
FIG. 10 is a photograph of a metallic structure of an example.
Figure 12:
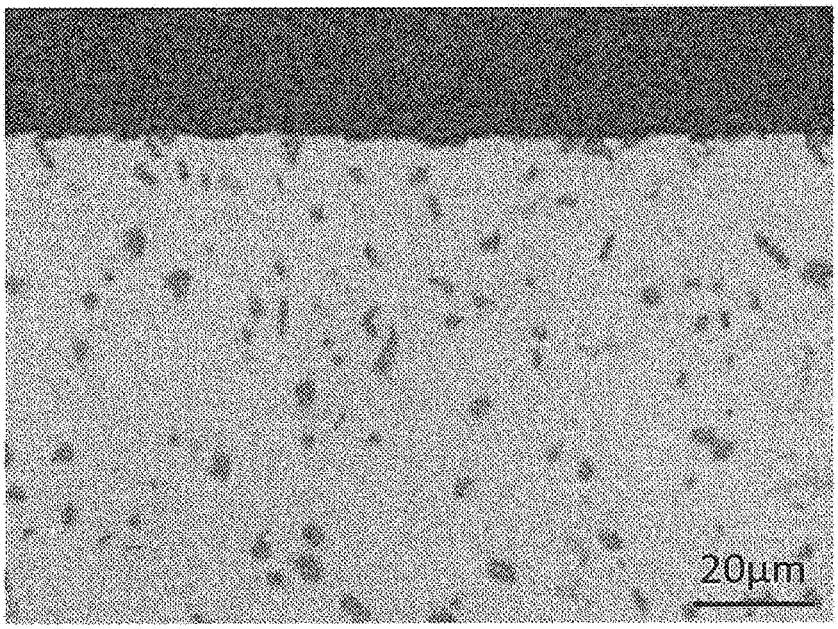
FIG. 12 is a photograph of a metallic structure of the example.
Figure 14:
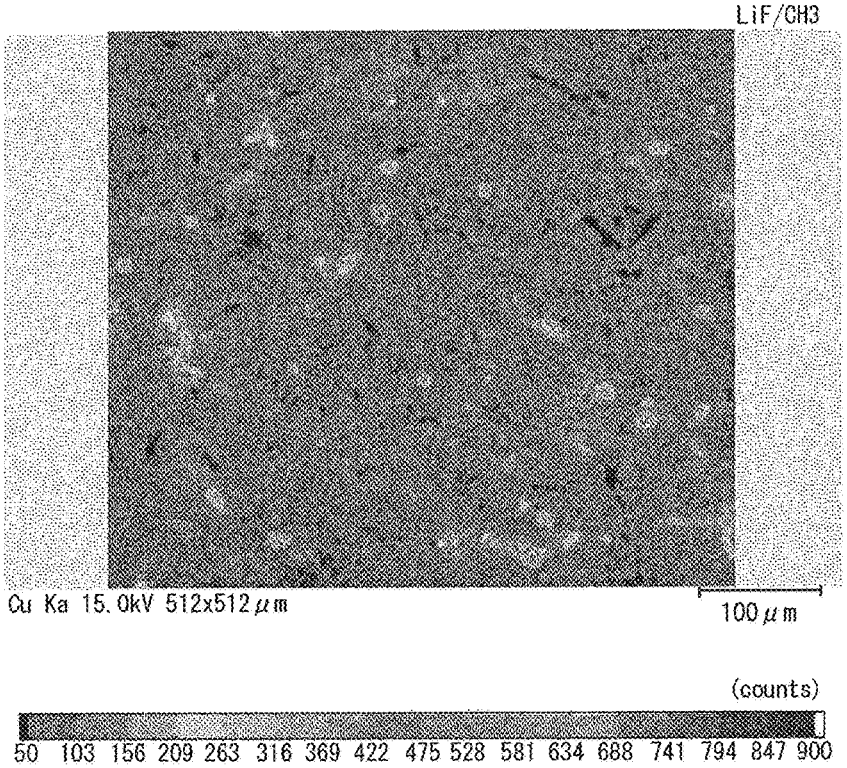
FIG. 14 is a distribution diagram showing a distribution of a content of Cu in a metallic structure of the example.
Figure 16:
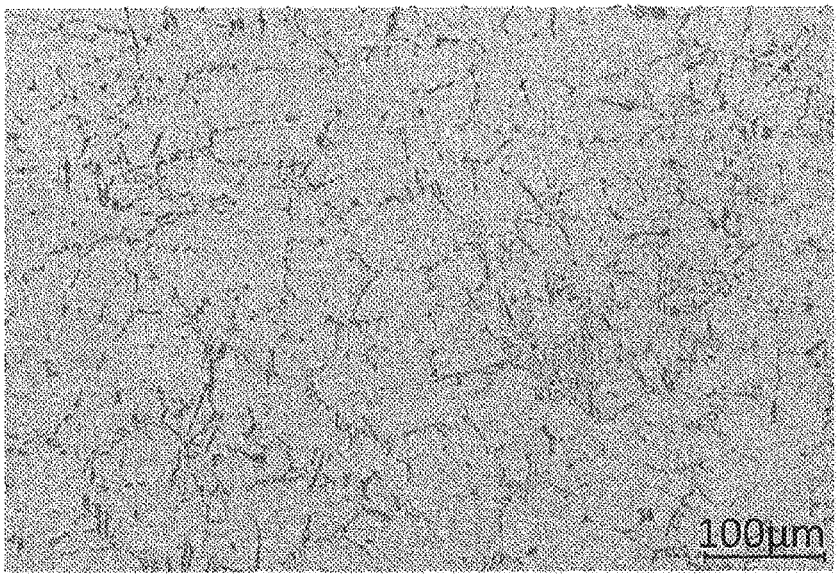
FIG. 16 is a photograph of a metallic structure of a reference example.
Figure 17:
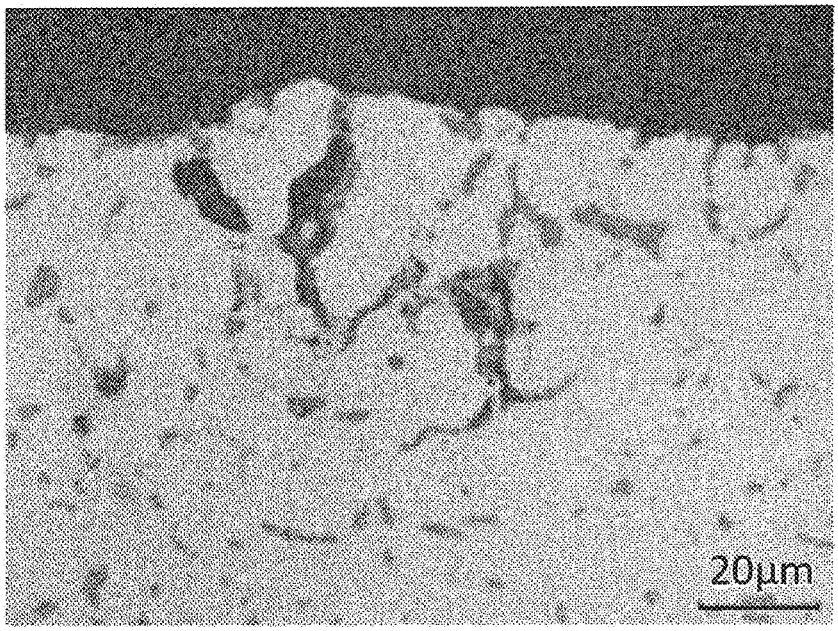
FIG. 17 is a photograph of a metallic structure of the reference example.
Figure 18:
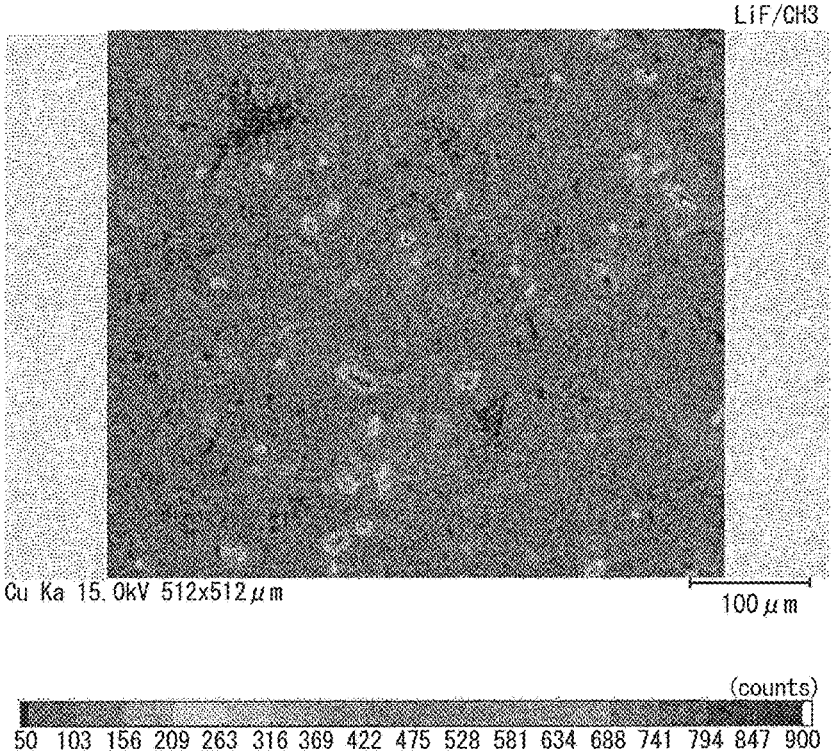
FIG. 18 is a distribution diagram showing a distribution of a content of Cu in a metallic structure of the reference example.
Figure 19:
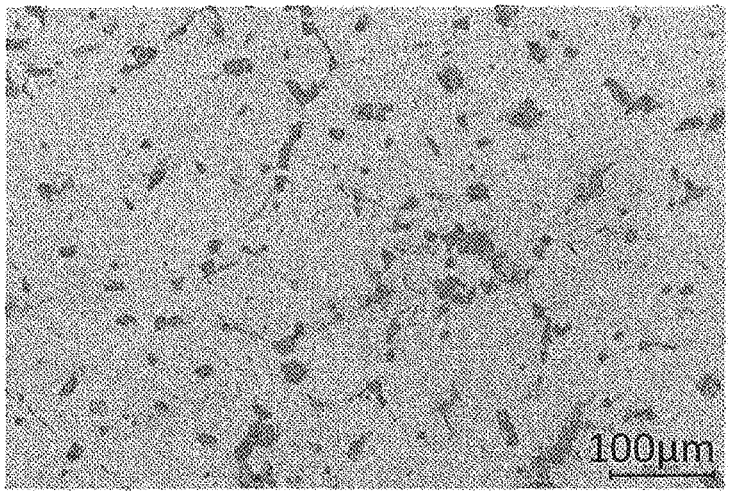
FIG. 19 is a photograph of a metallic structure of the reference example.
Figure 20:
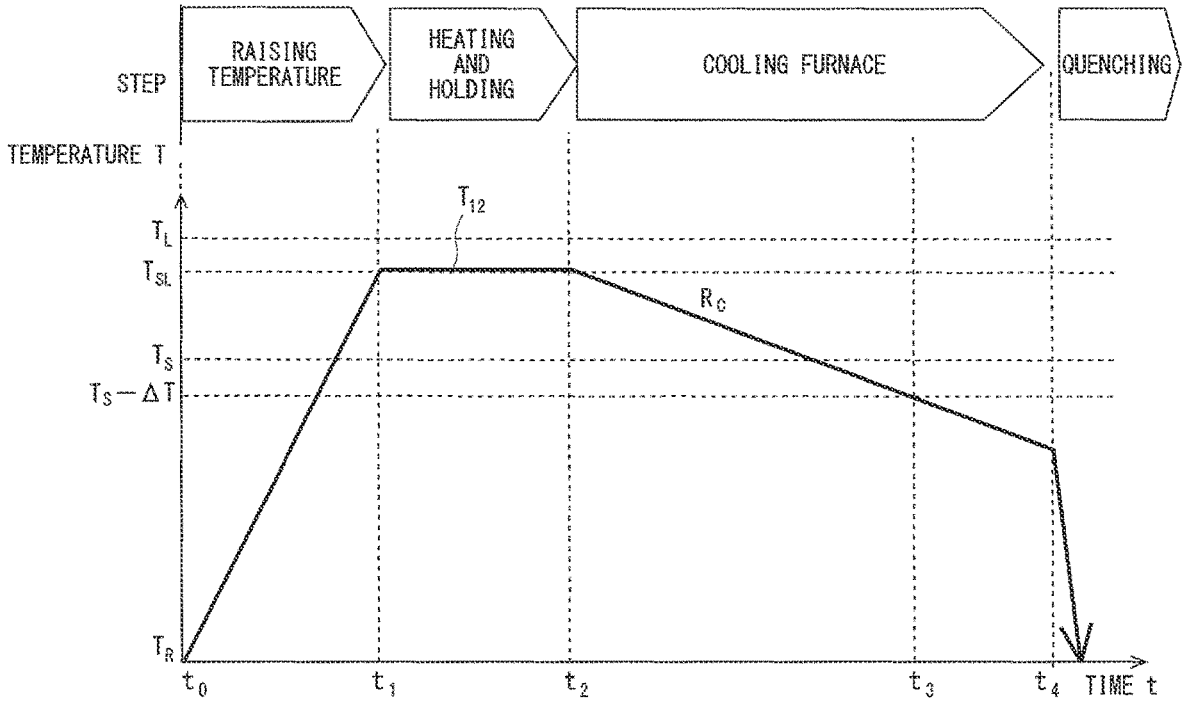
FIG. 20 is a temperature chart for the method for manufacturing an aluminum alloy member according to the problems to be solved by the present disclosure.

Further, metallic structures of each of the aluminum alloy member test pieces manufactured as described above were observed by using an optical microscope and a SEM (Scanning Electron Microscope). Further, an EPMA (Electron Probe Micro Analyzer) analysis was also conducted. Images photographed by performing the observation were shown in FIGS. 10, 12, 14, and 16 to 19. FIGS. 10 and 12 are photographs of a metallic structure of an example. FIG. 14 is a distribution diagram showing a distribution of a content of Cu in the metallic structure of the example. FIGS. 16, 17 and 19 are photographs of a metallic structure of a reference example. FIG. 18 is a distribution diagram showing a distribution of a content of Cu in the metallic structure of the reference example. Note that it was determined here that 0.2% proof stress of 270 MPa or higher, and breaking elongation of 2% or higher are satisfactory values.

Further, the manufacturing conditions shown in FIGS. 10 and 16 other than the heating and holding time $t_1$ to $t_2$ were set as follows: the heating and holding temperature $T_{SL}$ was 550[° C.]; the cooling rate Rc was 5[° C./min]; and the furnace pressure Pc was 0.9 [MPa]. The manufacturing conditions shown in FIGS. 12 and 17 other than the furnace pressure Pc [MPa] were set as follows: the heating and holding time $t_1$ to $t_2$ was 10 [min]; the heating and holding temperature $T_{SL}$ was 550[° C.]; and the cooling rate Rc was 5[° C./min] The manufacturing conditions shown in FIGS. 14 and 18 other than the heating and holding time $t_1$ to $t_2$ were set as follows: the heating and holding temperature $T_{SL}$ was between 540 and 555[° C.]; the cooling rate Rc was 3[° C./min]; and the furnace pressure Pc was 0.6 [MPa]. The manufacturing conditions shown in FIG. 19 other than the cooling rate Rc were set as follows: the heating and holding time $t_1$ to $t_2$ was 5 [min]; the heating and holding temperature $T_{SL}$ was between 540 and 555[° C.]; and the furnace pressure Pc was 0.6 [MPa].

As shown in FIG. 9, the 0.2% proof stress was not changed very much when the heating and holding time $t_1$ to $t_2$ was less than five minutes, whereas the breaking elongation was improved. When five minutes or more of the heating and holding time $t_1$ to $t_2$ elapsed neither the 0.2% proof stress nor the breaking elongation were changed very much, and satisfactory values were maintained. The heating and holding time $t_1$ to $t_2$ s preferably three minutes or more, further five minutes or more since the 0.2% proof stress and the breaking elongation have satisfactory values.

As shown in FIG. 10, in the metal structure of the aluminum alloy member test piece in the case where the heating and holding time $t_1$ to $t_2$ is five minutes, most of eutectics Si are dispersed and most of them have spherical shapes. On the other hand, as shown in FIG. 16, in the metal structure of the aluminum alloy member test piece in the case where the heating and holding time $t_1$ to $t_2$ is 0 minute, eutectics Si are unevenly distributed and most of them have acicular shapes. It is conceivable that one reason why the 0.2% proof stress and the breaking elongation had satisfactory values when the heating and holding time $t_1$ to $t_2$ was five minutes or more is that aspect ratios of most of the eutectics Si became smaller in the metallic structure of the aluminum alloy member test piece, and most of the eutectics Si have spherical shapes.

As shown in FIG. 11, when the furnace pressure Pc was between 0 and 0.7 MPa, the 0.2% proof stress and the breaking elongation were improved as the furnace pressure Pc increased. Compared to the case when the furnace pressure Pc was between 0.7 and 1.0 MPa, neither the 0.2% proof stress nor the breaking elongation were changed very much, and satisfactory values were maintained. The furnace pressure Pc is preferably between 0.6 and 0.9 MPa since the 0.2% proof stress and the breaking elongation have satisfactory values.

As shown in FIG. 12, when the furnace pressure Pc was 0.7 MPa, blowholes and vacancies were hardly present in the metallic structure of the aluminum alloy member test piece. On the other hand, as shown in FIG. 17, when the furnace pressure Pc was 0.5 MPa, blowholes and vacancies remain in the metallic structure of the aluminum alloy member test piece. It is conceivable that one reason why the 0.2% proof stress and the breaking elongation had satisfactory values when the furnace pressure Pc was between 0.6 and 0.9 MPa is that blowholes and vacancies were crushed in the metallic structure of the aluminum alloy member test piece and thereby hardly any of them remained therein.

As shown in FIG. 13, the 0.2% proof stress and the breaking elongation were high at the heating and holding temperature $T_{SL}$ of 530° C. or higher, and when the heating and holding temperature $T_{SL}$ was 550±5, that is, between 545 and 555° C., the 0.2% proof stress and the breaking elongation reached the peak thereof. Accordingly, the heating and holding temperature $T_{SL}$ are preferably between 530 and 560° C., further between 545 and 555° C. since the 0.2% proof stress and the breaking elongation have satisfactory values.

As shown in FIG. 14, when the heating and holding temperature $T_{SL}$ was 550° C., Cu atoms are uniformly dispersed in the metal structure of the aluminum alloy test piece. As shown in FIG. 18, when the heating and holding temperature $T_{SL}$ was 520° C., Cu atoms are unevenly distributed in the metal structure of the aluminum alloy test piece. It is conceivable that one reason why the 0.2% proof stress and the breaking elongation had satisfactory values when the heating and holding temperature $T_{SL}$ were between 530 and 560° C., further between 545 and 555° C. is that Cu atoms are uniformly dispersed in the metal structure of the aluminum alloy test piece.

As shown in FIG. 15, when the cooling rate Rc was between 0 and 5° C./min, the 0.2% proof stress and the breaking elongation were improved as the cooling rate Rc increased. When the cooling rate Rc was 5° C./min or higher, the 0.2% proof stress and the breaking elongation became constant. Accordingly, the cooling rate Rc is preferably 3° C./min or higher, further 5° C./min or higher since the 0.2% proof stress and the breaking elongation have satisfactory values.

As shown in FIG. 10, when the cooling rate Rc was 5° C./min, eutectics Si became fine and spherical shapes in the metal structure of the aluminum alloy test piece. As shown in FIG. 19, in the metal structure of the aluminum alloy member test piece in the case where the cooling rate Rc was 0.8° C./min, eutectics Si were coarse and clumpy shapes compared to the eutectics Si shown in FIG. 10. To be specific, the clumpy shapes are a substantially spheroid shape, or a substantially ellipsoidal shape. It is conceivable that one reason why the 0.2% proof stress and the breaking elongation had satisfactory values when the cooling rate Rc was 5° C./min or higher is that eutectics Si became fine and spherical shapes in the metallic structure of the aluminum alloy member test piece.

Note that the present disclosure is not limited to the above-described embodiment. Changes can be made to the present disclosure without departing from the spirit of the invention. From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A method for manufacturing an aluminum alloy member using an aluminum alloy casting material that contains 2.0 to 5.5 mass % of Cu, and 4.0 to 7.0 mass % of Si, wherein a content of Mg is 0.5 mass % or less, a content of Zn is 1.0 mass % or less, a content of Fe is 1.0 mass % or less, a content of Mn is 0.5 mass % or less, and the balance is made of Al and inevitable impurities, and the method for manufacturing an aluminum alloy member comprising:

placing the aluminum alloy casting material inside a pressurized furnace so as to be under a pressurized environment of 0.6 MPa or higher, heating the aluminum alloy casting material to a solid-liquid coexisting temperature region in the pressurized environment of 0.6 MPa or higher;

holding the aluminum alloy casting material within the solid-liquid coexisting temperature region in the pressurized environment of 0.6 MPa or higher;

and quench cooling the aluminum alloy casting material after performing the holding step, wherein in a quenching preparation step between the holding step and the quenching step, the aluminum alloy casting material is cooled at a cooling rate of 3° C./min or higher from the solid-liquid coexisting temperature region to a predetermined temperature ($T_S$-ΔT) lower than a liquid phase appearance temperature ($T_S$), wherein in the quenching preparation step, the aluminum alloy casting material is inside the pressurized furnace so as to be under a pressurized environment of 0.6 MPa or higher, and in the quenching step the aluminum alloy casting material is cooled to a normal temperature ($T_R$) after the pressure inside the pressurized furnace is removed to reach atmospheric pressure.

2. The method for manufacturing an aluminum alloy member according to claim 1, wherein a nozzle is provided inside the pressurized furnace, and in the quenching preparation step, a cooling gas medium or mist is blown from the nozzle to cool the aluminum alloy casting material.

3. The method for manufacturing an aluminum alloy member according to claim 1, wherein a contact part that contacts the aluminum alloy casting material is provided inside the pressurized furnace, the contact part having a shape conforming to a shape of the aluminum alloy casting material, a flow path is provided inside the contact part, and in the quenching preparation step, the aluminum alloy casting material is cooled by making a cooling medium flow through the flow path.

* * * * *